United States Patent [19]

Mausner

[11] Patent Number: 4,905,650

[45] Date of Patent: Mar. 6, 1990

[54] METHOD AND CIRCUIT FOR CONTROLLING THE AIR-FUEL RATIO OF AN INTERNAL COMBUSTION ENGINE

[75] Inventor: Eberhard Mausner, Bad Soden, Fed. Rep. of Germany

[73] Assignee: VDO Adolf Schindling AG, Frankfurt am Main, Fed. Rep. of Germany

[21] Appl. No.: 206,171

[22] Filed: Jun. 13, 1988

[30] Foreign Application Priority Data

Jun. 11, 1987 [DE] Fed. Rep. of Germany ..... 3719493

[51] Int. Cl.[4] ..... F02D 41/14

[52] U.S. Cl. ..... 123/440

[58] Field of Search ..... 123/440, 489, 589; 60/276

[56] References Cited

U.S. PATENT DOCUMENTS

| | | | |
|---|---|---|---|
| 4,029,061 | 6/1977 | Asano | 123/440 |
| 4,461,258 | 7/1984 | Becker et al. | 123/489 |
| 4,603,670 | 8/1986 | Bertsch et al. | 123/489 |

FOREIGN PATENT DOCUMENTS 0189185 7/1986 European Pat. Off. .

OTHER PUBLICATIONS

Patent Abstracts of Japan, vol. 6, No. 216 (M-168)[1094], 29 Oct. 1982 to JP-A-57-122145.

*Primary Examiner*—Andrew M. Dolinar
*Attorney, Agent, or Firm*—Martin A. Farber

[57] ABSTRACT

In a method for controlling the air-fuel ratio of an internal combustion engine in which the output voltage of an oxygen measurement probe which is arranged in the exhaust gas duct of the internal combustion engine is fed to a controller and the controller gives off a correcting variable for the air-fuel ratio, signals corresponding to the load and the speed of rotation of the internal combustion engine are furthermore fed to the controller. After each jump in the output voltage of the oxygen measurement probe there take place a first jump followed by, in each case, successive further jumps in the correcting variable. The direction of the jumps depends on the direction of the jump of the output voltage of the oxygen measurement probe while the amplitude of the further jumps is dependent on the load and the speed of rotation. Between the jumps, the correcting variable has a course which is substantially linear with time, the slope being predetermined and the direction corresponding to the direction of the jumps.

3 Claims, 1 Drawing Sheet

METHOD AND CIRCUIT FOR CONTROLLING THE AIR-FUEL RATIO OF AN INTERNAL COMBUSTION ENGINE

FIELD AND BACKGROUND OF THE INVENTION

The present invention relates to a method and a circuit for controlling the air-fuel ratio of an internal combustion engine in which the output voltage of an oxygen measurement probe which is arranged in the exhaust gas duct of an internal combustion engine is fed to a controller, and the controller gives off a correcting variable for the air-fuel ratio.

By controlling of the air-fuel ratio in this type of engine, it is desired primarily to reduce the quantity of noxious substances in the exhaust gases emitted by the internal combustion engines. There is known for this, for example, a method in which an oxygen measurement probe is arranged in the stream of the exhaust gas of the internal combustion engine, the probe contolling an integrating device, and the output signal of the exhaust gas measurement probe being connected to a threshold switch, and switching the latter upon the occurrence of the threshold value, the direction of integration of the integrating device being changed upon the switching of the threshold switch. As a function of at least one operating parameter of the internal combustion engine, in particular as a function of the amount of intake air of the internal combustion engine, the time constant of the integrating device is changed. The integrating device of variable time constant proposed in connection with the known method does not however satisfy the requirements with respect to accurate and adaptable regulation.

Accordingly it is an object of the invention to provide a method and a circuit therefor not having the above-mentioned disadvantages.

SUMMARY OF THE INVENTION

According to the method of the invention signals corresponding to the load and speed of rotation of the internal combustion engine are furthermore fed to the controller, after each jump in the output voltage of the oxygen measurement probe there is a first jump and then in each case successive further jumps in the correcting variable, the direction of the jumps is dependent on the direction of the jump of the output voltage of the oxygen measurement probe, the amplitude of the further jumps is dependent on the load and the speed of rotation, and there is a substantially linear change with time of the correcting variable between the jumps, the slope is preestablished and the direction corresponds to the direction of the jumps. The slope is in this connection preferably constant.

A further development of the method of the invention is that the value of the first jump is also dependent on the load and speed of rotation of the internal combustion engine.

One advantageous circuit for the carrying out of the method of the invention is characterized by the fact that the output of the oxygen measurement probe (1) is connected to the input of a threshold circuit (2) whose output signals can e fed, on the one hand, to an integrating member (3) and, on the other hand, to a proportional member (4), that the proportional member (4) can be acted on by signals which represent the load and the speed of rotation of the internal combustion engine, that the proportional member (4) is controlled via a logic circuit to which a time signal in the output voltage of the threshold circuit can be fed, and that the outputs of the proportional member (4) and of the integrating member (3) are connected to respective inputs of an adding circuit (9).

BRIEF DESCRIPTION OF THE DRAWINGS

With the above and other objects and advantages in view, the present invention will become more clearly understood in connection with the detailed description of a preferred embodiment, when considered with the accompanying drawing, of which.

DETAILED DESCRIPTION OF THE PREFERRED EMBODIMENT

Figure 1:
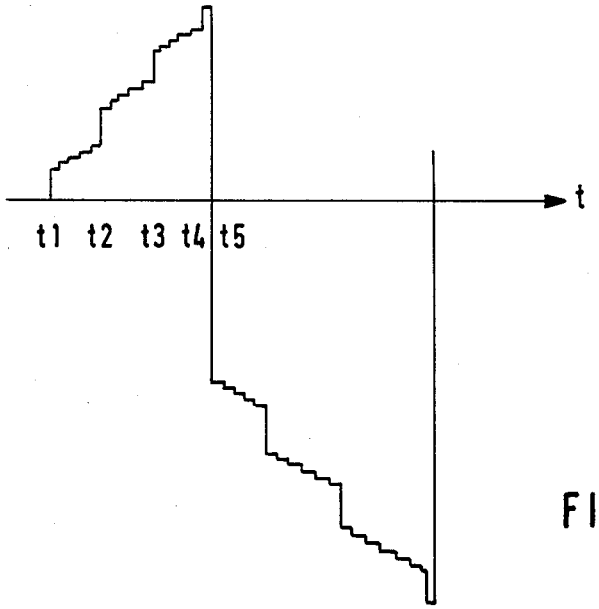
FIG. 1 is a time diagram of the correcting variable.

In the time graph shown in FIG. 1, a jump in the output voltage of the oxygen measurement probe is assumed at the time $T_1$, whereupon the correcting variable also shows a jump. At the time $T_2$ there is a second jump, at the time $T_3$ a third jump, and at the time $T_4$ a fourth jump. The periods of time between said times are predetermined. At the time T5 there is again a jump of the output voltage of the oxygen measurement probe which results in a jump in the correcting variable, which is then followed by further jumps. Between the jumps, the correcting variable folows a course which is substantially linear with time and has a predetermined, constant slope. This course is stepshaped in the showing of FIG. 1 due to the use of digital circuits.

Figure 2:
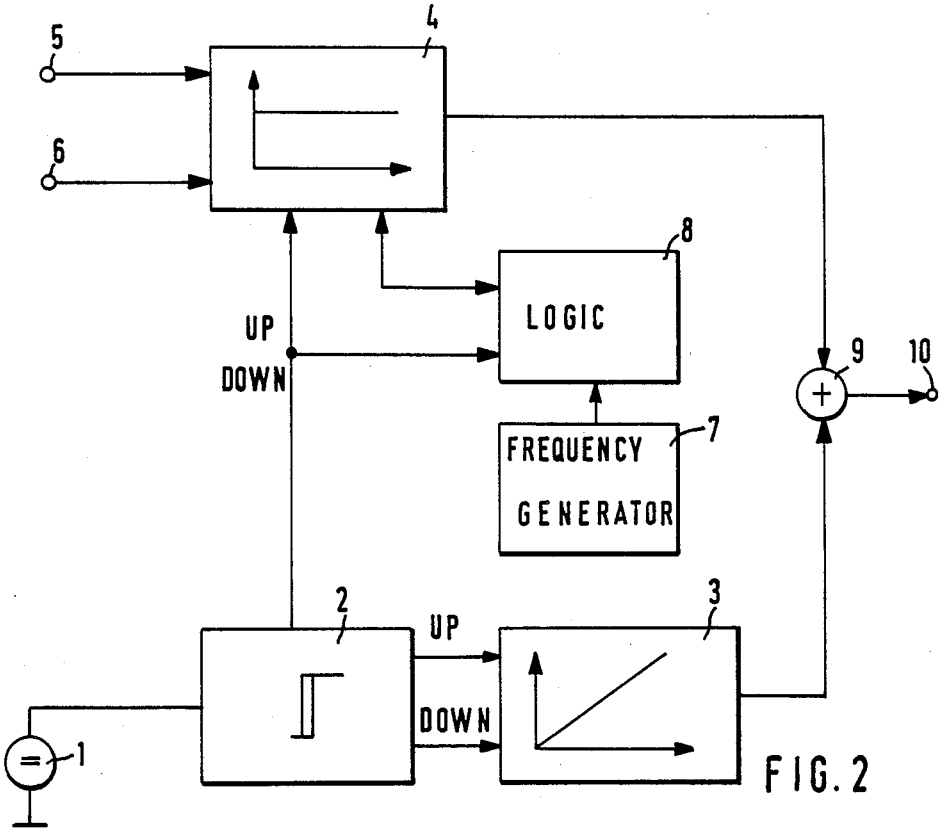
FIG. 2 is a block diagram of a circuit for the carrying out of the method of the invention.

In the circuit arrangement of FIG. 2, the output of an oxygen measurement probe 1 is connected to the input of a known threshold circuit 2. The threshold circuit controls the direction of integration of an integrating member 3, the slope of the course of the output voltage whch is linear with time being preestablished.

Furthermore, the output signal of the threshold circuit 2 controls the direction of the jumps of the correcting variable which are produced in a proportional member 4. For the control of the amplitude of the jumps, signals which represent the speed of rotation and load of the internal combustion engine are fed to the proportional member 4 via inputs 5, 6. The repetition frequency of the further jumps is determined in a frequency generator 7. In a logic circuit 8, the direction of the further jumps is derived from the output signal of the threshold circuit 2. The outputs of the proportional member 4 and the integrating member 3 are connected to the inputs of an addition circuit 9, from the output 10 of which the correcting variable can be taken.

The invention is not limited to the embodiment described. Thus, for instance, the method of the invention can also be carried out with a controller which contains a correspondingly programmed microcomputer.

Advantages of the invention reside inter alia in the fact that only a single characteristic diagram (load, speed of rotation, proportional jump) is required and that the preferably constant integrator slope can easily be produced in the computer. In this way, the computation time and storage capacity are kept very low.

I claim:

1. A method for controlling the air-fuel ratio of an internal combustion engine, in which engine the output voltage of an oxygen measurement probe located in an exhaust gas duct of the engine is fed to a controller, and wherein the controller gives off a correcting variable for controlling the air-fuel ratio, the method comprising the steps of:

feeding to the controller signals corresponding to the load and speed of rotation of the engine controller, there being jumps in the output voltage of the oxygen measurement probe;

providing a correcting variable for control of the air-fuel ratio;

after each jump in the output voltage of the oxygen measurement probe, inserting a first jump and then in each case successive further jumps in the correcting variable; and wherein in said inserting step, the direction of the jumps is dependent on the direction of the jump of the output voltage of the oxygen measurement probe, the amplitude of the further jumps is dependent on the load and the speed of rotation of the engine, and there is a substantially linear change with time of the correcting variable between the jumps, the slope of the correcting variable being preestablished and the direction of change of the correcting variable corresponding to the direction of the jumps.

2. A method according to claim 1, wherein a value of the first jump is also dependent on the load and speed of rotation of the engine.

3. A method according to claim 1, wherein the slope of a change in the correcting variable is constant.

* * * * *